United States Patent [19]

Saita et al.

[11] Patent Number: 4,992,216

[45] Date of Patent: Feb. 12, 1991

[54] METHOD FOR PRODUCING OZONE-CONTAINING WATER

[75] Inventors: Kozo Saita, Oamishirasato; Hisayuki Kawano, Mobara; Takeshi Utsuki, Yokosuka, all of Japan

[73] Assignee: Ise Kagaku Kogyo Kabushiki Kaisha, Tokyo, Japan

[21] Appl. No.: 455,842

[22] Filed: Dec. 20, 1989

Related U.S. Application Data

[63] Continuation of Ser. No. 302,908, Jan. 30, 1989, abandoned.

[30] Foreign Application Priority Data

Jan. 29, 1988 [JP] Japan ..... 63-17170

[51] Int. Cl.[5] ..... B01F 3/04

[52] U.S. Cl. ..... 261/122; 261/DIG. 75; 261/DIG. 42

[58] Field of Search ..... 261/DIG. 75, 122, DIG. 42

[56] References Cited

U.S. PATENT DOCUMENTS 4,360,234 11/1982 Hsueh et al. ..... 261/122
4,382,044 5/1983 Baumgartner et al. .... 261/DIG. 42
4,555,335 11/1985 Burris ..... 261/DIG. 42
4,781,889 11/1988 Fukasawa et al. ..... 261/122
4,818,447 4/1989 Iwasaki ..... 261/DIG. 75

FOREIGN PATENT DOCUMENTS 57-140334 8/1982 Japan .
649918 7/1953 United Kingdom ..... 261/DIG. 75

OTHER PUBLICATIONS

Random House College Dictionary, Apr. 1982, p. 844.

*Primary Examiner*—Tim Miles
*Attorney, Agent, or Firm*—Oblon, Spivak, McClelland, Maier & Neustadt

[57] ABSTRACT

Flowing an ozone-containing gas through one passage which is either the space between an outer tube and an inner tube disposed in the outer tube or the space in the inner tube, and flowing an aqueous liquid through the passage, which the ozone-containing gas is not flowing through, provides aqueous ozone solutions of high concentration and purity provided that the inner tube possesses a number of pores with an average diameter of 2 to 4 microns.

12 Claims, 1 Drawing Sheet

METHOD FOR PRODUCING OZONE-CONTAINING WATER

This application is a continuation of application Ser. No. 07/302,908, filed on Jan. 30, 1989, now abandoned.

BACKGROUND OF THE INVENTION

1. Field of the Invention

The present invention relates to a method and an apparatus for producing ozone-containing water.

2. Discussion of the Background

Ozone-containing water is used for sterilizing vegetables, corns, meat, water, or the like or decomposing impurities in water. The ozone-containing water has been previously produced by the so-called bubbling method in which an ozone-containing gas generated in an ozone generator is absorbed into an aqueous liquid or by a method in which a liquid is caused to flow in a pipe while an ozone-containing gas is introduced into the pipe, and the liquid is agitated by means of baffles arranged in the pipe.

However, the conventional methods as mentioned above have the following problems to be solved.

In general, ozone has a comparatively low rate of dissolving and a comparatively low solubility in aqueous liquids. Since the dissolving rate decreases as the concentration of ozone dissolved in the aqueous liquid approaches the solubility which is specifically determined by pressure and temperature, it is difficult to obtain a solution having a high concentration of ozone. In addition, since impurities in the form of fine particles having a size in the range of about 0.5 to 1 micron are often included in an ozone-containing gas which is used on an industrial basis, and they are consequently introduced into the resultant solution which is produced using such gas, a solution produced by the conventional methods mentioned above is not suitable as a raw material for producing products having a high purity usable for fine chemistry or the like.

Although it is possible to produce a high purity ozone-containing solution by employing (i) a means for removing fine particles from the starting material for the ozone-containing gas using a filter or (ii) a means for filtering a solution with an ozone-containing gas dissolved therein using a filter, a number of man hours are required for practicing the method as proposed above.

A method of dissolving oxygen from air into water using a porous tube has been disclosed (Japanese Laid-Open Patent No. 215339/1987). An ozone-containing water with no impurities can be obtained by employing this method for producing an ozone-containing water. However, this method suffers from the drawbacks that it is difficult to produce an ozone-containing water having a high content of ozone. A high pressure, in the range of 2 to 3 $Kg/cm^2 \cdot G$, of an ozone-containing gas is required, and moreover, an ozone generator in larger dimensions to produce an ozone-containing gas on an industrial scale must be designed.

Further, when an apparatus for carrying out the above method is used for producing ozone-containing water, production is achieved at a low efficiency and it is difficult to produce a large amount of ozone-containing water on an industrial scale.

Thus, there remains a need for a method and an apparatus for producing ozone-containing water which do not suffer from the above-mentioned drawbacks.

SUMMARY OF THE INVENTION

Accordingly, one object of the present invention is to provide a novel method for the production of ozone-containing water which achieves a high efficiency on an industrial scale.

It is another object of the present invention to provide a novel method for the production of ozone-containing water which yields solutions containing a high concentration of ozone.

It is a further object of the present invention to provide a method for the production of ozone-containing water which provides an ozone-containing solution of high purity.

It is yet a further object of the present invention to provide a novel apparatus for producing ozone-containing water of high concentration and purity with a high efficiency on an industrial scale.

These and other objects which will become apparent during the following detailed description have been achieved by flowing an ozone-containing gas through one of two passages which is either (i) the space between an outer tube and an inner tube disposed in the outer tube or (ii) the space in the inner tube, and flowing an aqueous-liquid through the passage other than that which the ozone containing gas is flowing through, provided that the inner tube contains a large number of pores with an average diameter of 2 to 4 microns.

BRIEF DESCRIPTION OF THE FIGURE

A more complete appreciation of the invention and many of the attendant advantages thereof will be readily obtained as the same become better understood by reference to the following detailed description when considered in connection with the accompanying drawing, wherein.

DETAILED DESCRIPTION OF THE PREFERRED EMBODIMENTS

Figure 1:
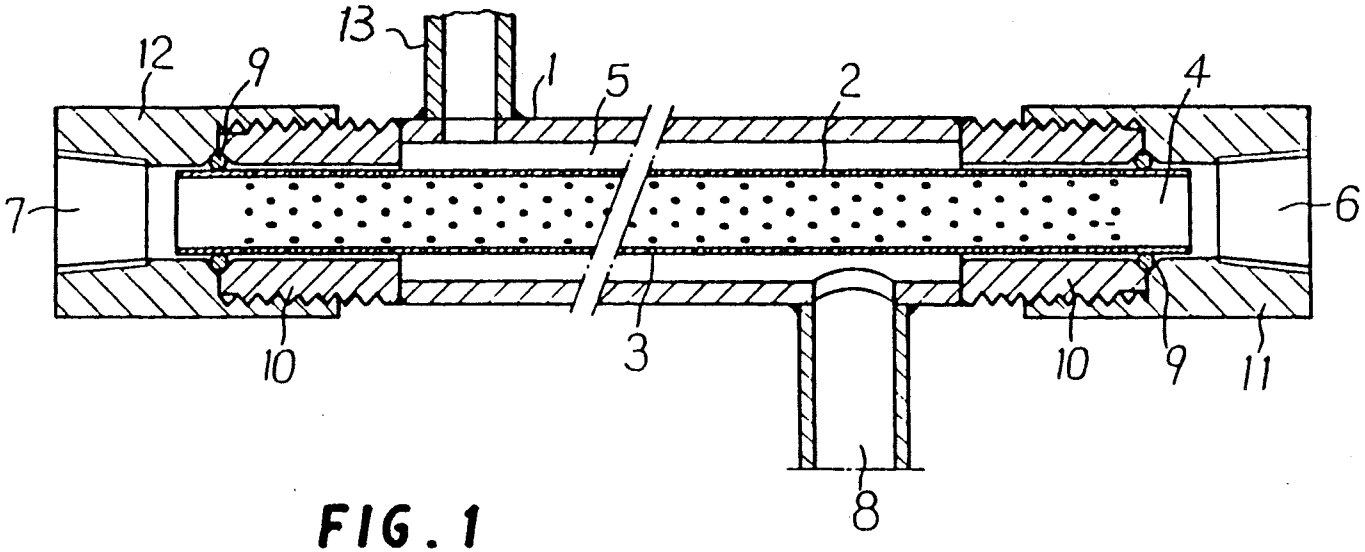
FIGURE 1 is a sectional view of an apparatus for carrying out the present method.

It has been found that highly preferable results are obtained with an arrangement of an inner tube having a large number of fine pores formed therein with an average diameter in the range of 2 to 4 microns disposed in an outer tube to form a fluid passage in the inner tube and another fluid passage between the inner and outer tubes, and introducing an ozone-containing gas into one of the fluid passages to flow therethrough and flowing an aqueous liquid through the other fluid passage, whereby ozone is introduced into the aqueous liquid through the inner tube so as to allow the former to be dissolved in the latter.

One embodiment of the present method is depicted in FIGURE 1, wherein Reference 1 represents an outer tube, Reference 2 represents an inner tube, Reference 3 represents a number of fine pores, References 4 and 5 represent fluid passages, Reference 6 represents an introduction port, Reference 7 represents a discharge port, Reference 8 represents a supply port, Reference 9 represents an O-ring, Reference 10 represents a support tube, References 11 and 12 represent caps and Reference 13 represents an exit port.

Any available tube having adequate size and strength may be used for the outer tube, and there are no limitations on the outer diameter and wall thickness of the outer tube.

A pipe made of metallic material having an excellent resistance against ozone such as stainless steel or the like is preferably employed for the outer tube 1. Dimensions of the outer pipe 1 such as outer diameter, wall thickness, and the like are readily determinable depending on the quantity of ozone-containing water to be produced per unit time. For example, one may use a system in which the dimensions of the outer tube 1 are an outer diameter of about 22 mm and a wall thickness of about 2.8 mm.

The inner tube 2 is concentrically disposed in the interior of the outer tube 1 while protruding outwardly from the opposite ends of the outer tube 1. Support tubes 10 are secured to the opposite ends of the outer tube 1. Each of the support tubes 10 is so dimensioned that it has substantially the same outer diameter as that of the outer tube 1 and substantially the same inner diameter as the outer diameter of the inner tube 2. The outer surfaces of the respective support tubes 10 are threaded so as to permit cap members 11 and 12 to be threadably engaged with the support tubes 10. O-rings 9 are located at abutment portions between the cap members 11 and 12 and the support tubes 10 so that the inner tube 2 is held in position by means of the O-rings 9.

The inner tube 2 is produced using material having a large number of fine pores 3 formed therein with a diameter selectively set in the range of 2 to 4 microns.

It is essential that the diameter (average diameter) of the fine pores 3 is maintained within the above range. If the fine pores 3 have a diameter smaller than the diameter as defined by the above range, there arises a need of using an ozone-containing gas having a high pressure in order to assure that ozone is introduced into the aqueous solution. When an ozone-containing gas having such a high pressure is used for producing ozone-containing water, it results in the generation of a number of bubbles having a large diameter. Thus, good results are not obtained.

Further, if the fine pores 3 have a diameter larger than the diameter as defined above, the result is that bubbles, generated by introduction of the ozone-containing gas into the aqueous solution, have a larger diameter, causing the solubility of ozone to be reduced. Consequently, an ozone-containing water having a high concentration can not be produced.

It is preferable that the fine pores 3 have a uniform diameter, and it is preferred that the deviation ($\sigma$) in diameter of the fine pores 3 be maintained within the range less than 10% of their average diameter.

In addition, it is preferred that the number of fine pores 3 is such that the inner tube 2 has a porosity in the range of 50 to 60%.

By reducing $\sigma$ it is possible to increase the productive efficiency and produce an ozone-containing water having a high concentration.

When the inner tube has an excessively high porosity, it tends to have a reduced mechanical strength. On the other hand, when it has an excessively low porosity, it becomes difficult to produce an ozone-containing water having a high concentration.

The diameter and a wall thickness of the inner tube 2 are generally determined in dependence on the quantity of ozone-containing water to be produced per unit time and other parameters. A typical example of the inner tube 2 is one that has an outer diameter of about 10 mm and a wall thickness of 0.4 to 1 mm, preferably 0.5 to 0.7 mm.

A stainless steel pipe having fine pores formed by using a laser may be employed for the inner tube 2. However, it is preferable that the inner tube 2 be made of porous glass, and this embodiment will be described below. It has been found that an inner tube 2 made of porous glass has a small value of $\sigma$ and provides the advantageous effect of increased efficiency of ozone-containing water production.

In the case where porous glass is employed for the inner tube 2, it is preferred that it has a wall thickness in the range of 0.4 to 1 mm, most preferably in the range of 0.5 to 0.7 mm.

When the inner tube is made of porous glass in that way, good results are obtained by using an ozone-containing gas having a lower pressure. Particularly, it has been found that very good results are obtained by using an ozone-containing gas having a pressure in the range of 0.5 to 1.5 $Kg/cm^2 \cdot G$, where G stands for gauge.

If the pressure is higher than the above-defined range, the result is that bubbles generated by the ozone-containing gas introduced into the aqueous liquid have an increased diameter and the resultant ozone-containing water exhibits a reduced ozone solubility and a reduced ozone concentration.

In contrast, if the pressure is lower than this range, the amount of ozone introduced into the aqueous liquid is reduced and the ozone-containing water thereby has a reduced concentration.

It is preferred that the porous glass (hereinafter referred to as porous glass A or B) employed as the material for the inner tube 2 is produced by the steps of heat treating a glass (hereinafter referred to as glass A) which contains 45 to 75% by weight of $SiO_2$, 8 to 30% by weight of $B_2O_3$, 8 to 25% by weight of CaO, 5 to 15% by weight of $Al_2O_3$, 3 to 8% by weight of $Na_2O$, 1 to 5% by weight of $K_2O$, 4 to 13% by weight of $Na_2O + K_2O$, and 0 to 8% by weight of MgO or a glass (hereinafter referred to as glass B) which contains 45 to 70% by weight of $SiO_2$, 8 to 30% by weight of $B_2O_3$, 8 to 25% by weight of CaO, and 5 to 15% by weight of $Al_2O_3$, to bring about a separation of a phase including $B_2O_3$ and CaO as main components from the heat treated glass; and removing the phase from the glass by dissolution. Consequently, a porous material having a high mechanical strength and a large number of fine pores 3 with uniform diameter formed therein is obtained. It has been found that it is easy to set the diameter of the fine pores 3 to a required diameter in a manner to be described later. The inner tube made of porous glass can be produced by heat treating a pipe-shaped material comprising glass including the components A or B, separating the phases of CaO and $B_2O_3$ from the pipe-shaped material, and then removing the phases (hereinafter referred to as CaO phase and $B_2O_3$ phase) from the latter by dissolution using acid solution.

There is seen a tendency that the CaO phase and $B_2O_3$ phase are increased by raising the heat treatment temperature and prolonging the heat treatment time, and the fine pores formed on the resultant porous glass have an increased diameter when the heat treatment temperature and time are increased. Thus, the diameter of fine pores can be set to a required value of diameter by selecting the glass composition and heat treatment conditions. It is particularly preferred that a porous material having a large number of fine pores formed therein with a diameter in the range of about 20,000 to 40,000 angstroms is employed for carrying out the present invention. The thus-produced porous glass is formed with a large number of fine pores having an uniform diameter and therefore it is very suitable for accomplishing the object of the present invention.

Glass which has been heat treated is immersed in an acid solution of HCl, $H_2SO_4$, $HNO_3$, or the like to remove the CaO phase and $B_2O_3$ phase. It is preferred that the surface of the glass be subjected to etching in HF solution for a short period of time prior to performing the heat treatment.

As described above, the diameter of the fine pores formed in the porous glass can be controlled as required by the operative conditions for heat treatment. It has been found that the diameter of fine pores varies, depending on the amount of $B_2O_3$ remaining in the porous glass, and the remaining amount of $B_2O_3$ depends on the operative conditions of heat treatment and acid treatment. Further, it has been found that good results are obtained by controlling these operative conditions in such manner that 0.5% and more by weight of $B_2O_3$ preferably remains in the porous glass.

Preferred treatment conditions are as noted below:

| | |
|---|---|
| heating temperature | 600 to 850° C.; |
| heating time | 2 to 48 hr, preferably 12 to 24 hr; |
| acid used | HCl, $H_2SO_4$, $HNO_3$; |
| concentration of acid | 0.01 to 2.0 N, preferably 0.1 to 1.0 N; |
| treating time | 2 to 20 hr, preferably 4 to 16 hr; and |
| temperature | 50 to 98° C., preferably 80 to 90° C.. |

The present method will now be described in the context of the above described embodiments.

An aqueous liquid such as deionized water or the like is introduced into one of the fluid passages, preferably the fluid passage 4 in the inner tube 2 to flow therethrough, while an ozone-containing gas is introduced into the other passage, preferably the fluid passage 5 provided between the inner and outer tubes.

Ozone is introduced into the aqueous liquid through the large number of fine pores 3 formed in the inner tube 2 and then dispersed under the effect of shearing force caused by flowing of the aqueous liquid so as to allow it be dissolved in the aqueous liquid.

It is preferred that the flow speed of the aqueous liquid is in the range of about 2 to 10 m/sec.

In the case as shown in FIGURE 1, an aqueous liquid is introduced into the fluid passage 4 via an introduction port 6 in the cap member 11 to flow therethrough and then discharged via a discharge port 7 in the cap member 12. The ozone-containing gas is introduced via supply port 8.

According to the present invention, fine particles included in the ozone-containing gas are removed while the gas passes through the number of fine pores formed in the porous material, so that a high purity ozone-containing solution can be obtained. Further, it has been found that even in the case where ozone is dissolved in the liquid at a high speed and under a low pressure, a solution having a concentration more than the saturated concentration can be obtained at a high productive efficiency. The size of fine particles which can be removed from the gas is determined by the diameter of the fine pores and the wall thickness of the porous material. Fine particles having a size equal to about one tenth of the diameter of the fine pores can be removed effectively.

Another embodiment may be practiced by an arrangement of tube plates (not shown) provided at opposite ends of the outer tube 1 and one or more holes formed on the tube plates so that one or more inner tubes are secured to the tube plates by inserting them into the holes. According to this method, a plurality of inner tubes can be extended in parallel to each other.

In this case, it is preferred that the respective inner tubes 2 are arranged in parallel to the center axis (not shown) of the outer tube 1 in an equally spaced relationship from the outer tube 1 and moreover that they are arranged in such a manner that the distance between adjacent inner tubes is kept nearly constant.

Alternatively, the method of the invention may be practiced in such a manner that an ozone-containing gas is supplied into the inner tube 2 and an aqueous liquid is supplied into the fluid passage 5 between both the inner and outer pipes.

According to the present invention, an inner tube having a number of fine pores formed therein with an average diameter in the range of 2 to 4 microns is disposed in the outer tube to form a fluid passage in the inner tube and another fluid passage between both the inner and outer tubes. An ozone-containing gas is introduced into one of the passages to flow therethrough and an aqueous liquid is introduced into the other passage to flow therethrough whereby the ozone passing through the inner tube is brought into contact with the aqueous solution so as to allow the former to be dissolved in the latter. Thus, the ozone which has passed through the fine pores can be effectively dispersed and dissolved in the aqueous liquid under the effect of shearing force caused by flowing of the aqueous liquid. In addition, fine particles included in the gas can be removed therefrom while the ozone-containing gas passes through the fine pores.

Other features of the invention will become apparent in the course of the following descriptions of exemplary embodiments which are given for illustration of the invention and are not intended to be limiting thereof.

EXAMPLES

In Example 1 and Comparative Examples 1 and 2, an apparatus as described in FIGURE 1 was used.

EXAMPLE 1

A straight pipe-shaped molded body made of glass of composition 65% by weight of $SiO_2$, 15% by weight of $Al_2O_3$, 6% by weight of CaO + MgO, and 8% by weight of $B_2O_3$ and which had a wall thickness of 0.55 mm, an inner diameter of 8.8 mm and a length of 320 mm was heated at 760° C. for 20 hr and then immersed in a 2% HF solution for 30 min so as to allow its outer surface to be subjected to etching. Next, it was immersed in a 1N HCl solution at 80° C. for 6 hr whereby a porous tube having an effective length of 320 mm with a number of fine pores 3 having an average diameter of 30,000 angstroms (3 microns) formed therein was produced. The resultant porous tube made of porous glass was used for an inner tube 2. The inner tube had a porosity in the range of 50 to 60% and the diameter of the respective fine pores 3 had a deviation ($\pi$) of 5%.

Support tubes 10 and cap members 11 and 12 were disposed at opposite ends of an outer tube 1 of stainless steel having an inner diameter of 16 mm, and the inner tube 2 was coaxially secured to the outer tube 1 via O-rings 9. A gas containing an ozone concentration of 23 mg/l and fine particles having a diameter in the range of 0.5 to 1 micron was supplied at a pressure of 0.8 $Kg/cm^2 \cdot G$ in a fluid passage 5 between both the inner and outer tubes through a supply port 8 on the outer tube 1 at a flow rate of 2 liter/min. Pure water was supplied through the supply port 6 at the outer end of the cap member 11 at a flow rate of 15 liter/min as to allow it to flow through a fluid passage 4 in the inner tube 2 at a speed of 4.7 m/sec, and then, it was discharged from the discharge port 7. In this way, the ozone was introduced into the pure water through the fine pores 3 in the inner tube 2 so as to allow the ozone to be dissolved in the water whereby an ozone-containing water having an ozone content of 2 ppm could be produced.

COMPARATIVE EXAMPLE 1

A pipe having a large number of fine pores formed therein with an average diameter set to 1.5 microns was used in place of the inner tube in Example 1.

When the ozone-containing gas had a pressure of 1.6 $Kg/cm^2 \cdot G$, bubbles produced by the ozone-containing gas which had passed through the fine pores had a diameter of about 10 mm. The concentration of the resultant ozone-containing water was reduced to about a half of the concentration in Example 1.

When the gas had a pressure of 1 $Kg/cm^2 \cdot G$, the diameter of the bubbles was reduced to about 2 to 3 mm. In this case, however, the concentration of the resultant ozone-containing water was reduced to a level of less than about 1/20 of the concentration in Example 1.

COMPARATIVE EXAMPLE 2

A pipe having a large number of fine pores formed therein with an average diameter set to 5 microns was used in place of the inner tube in Example 1. When an ozone-containing gas had a pressure of 0.5 $Kg/cm^2 \cdot G$, the diameter of bubbles in the water was about 10 mm, and the concentration of the resultant ozone-containing water was less than one half of the concentration in Example 1.

As clearly demonstrated by the example given above, the present invention provides ozone-containing water having a high content of ozone without fine particles included therein by using a gas with a low pressure, in the range of about 0.5 to 1.5 $Kg/cm^2 \cdot G$, as an ozone-containing gas.

Obviously, numerous modifications and variations of the present invention are possible in light of the above teachings, it is therefore to be understood that within the scope of the appended claims, the invention may be practiced otherwise than as specifically described herein.

What is claimed as new and desired to be secured by Letters Patent of the United States is:

1. A method for producing ozone-containing water, which comprises the steps:

(i) flowing an ozone-containing gas through a first passage which is the space between an outer tube and an inner tube disposed in said outer tube; and (ii) flowing an aqueous liquid through a second passage which is the space in said inner tube, wherein said inner tube possesses a plurality of pores with an average diameter of 2 to 4 microns.

2. The method of claim 1, wherein said inner tube has a porosity in the range of 50–60%.

3. The method of claim 1, wherein the deviation of the diameter of said pores is less than 10% of the average diameter of said pores.

4. The method of claim 1, wherein said ozone-containing gas has a pressure in the range of 0.5 to 1.5 $Kg/cm^2 \cdot G$.

5. The method of claim 1, wherein said aqueous liquid flows through said second passage with a flow speed of 2 to 10 m/sec.

6. The method of claim 1, wherein said inner tube is porous glass.

7. A method for producing ozone-containing water, which comprises the steps:

(i) flowing an aqueous liquid through a first passage which is the space between an outer tube and an inner tube disposed in said outer tube; and (ii) flowing an ozone-containing gas through a second passage which is the space in said inner tube, wherein said inner tube possesses a plurality of pores with an average diameter of 2 to 4 microns.

8. The method of claim 7, wherein said inner tube has a porosity in the range of 50–60%.

9. The method of claim 7, wherein the deviation of the diameter of said pores is less than 10% of the average diameter of said pores.

10. The method of claim 7, wherein said ozone-containing gas has a pressure-in the range of 0.5 to 1.5 $Kg/cm^2 \cdot G$.

11. The method of claim 7, wherein said aqueous liquid flows through said first passage with a flow speed of 2 to 10 m/sec.

12. The method of claim 7, wherein said inner tube is porous glass.

* * * * *